United States Patent [19]

Armstrong

[11] Patent Number: 4,483,659

[45] Date of Patent: Nov. 20, 1984

[54] AXIAL FLOW IMPELLER

[76] Inventor: Richard J. Armstrong, 7 Jackes Ave., Apt. 703, Toronto, Ontario, M4T 1E3, Canada

[21] Appl. No.: 537,191

[22] Filed: Sep. 29, 1983

[51] Int. Cl.[3] ..... F04D 29/38

[52] U.S. Cl. ..... 416/200 R; 416/223 A; 416/231 B; 415/181

[58] Field of Search ..... 416/200 R, 200 A, 231 B, 416/198 A, 223 A; 415/181

[56] References Cited

U.S. PATENT DOCUMENTS

| | | | |
|---|---|---|---|
| 1,834,135 | 12/1931 | Perlain | 416/200 X |
| 2,045,383 | 6/1936 | Faber | 416/231 B |
| 2,314,572 | 3/1943 | Chitz | 416/231 B X |
| 2,619,318 | 11/1952 | Schaer | 416/200 A |
| 2,720,928 | 10/1955 | Warto | 416/500 X |
| 2,783,965 | 3/1957 | Birmann | 416/198 A X |
| 2,982,361 | 5/1961 | Rosen | 415/DIG. 1 X |
| 3,597,109 | 8/1971 | Petrie et al. | 416/198 A |
| 3,867,062 | 2/1975 | Troller | 416/223 A X |
| 4,306,839 | 12/1981 | Pien | 416/200 R |

FOREIGN PATENT DOCUMENTS

| | | | |
|---|---|---|---|
| 227725 | 1/1920 | Fed. Rep. of Germany | 416/200 |
| 1932611 | 1/1971 | Fed. Rep. of Germany | 416/231 B |
| 1060663 | 4/1954 | France | 416/231 B |
| 313869 | 1/1934 | Italy | 416/231 B |
| 497761 | 9/1954 | Italy | 416/200 |
| 274302 | 6/1970 | U.S.S.R. | 416/231 B |

*Primary Examiner*—Everette A. Powell, Jr.

*Attorney, Agent, or Firm*—Arne I. Fors; Robert F. Delbridge

[57] ABSTRACT

Axial flow impeller having at least two rows, preferably three rows, of a plurality of blades secured substantially radially to a rotor for rotation in a plane about the axis of the rotor. The blades have the same pitch throughout their lengths with the blades of the first row having a pitch angle less than the stall angle of the blades, preferably about 22°, the blades of the second row having a pitch angle greater than the pitch angle of the blades of the first row and less than the stall angle of the blades, preferably about 13° greater than the pitch angle of the first row of blades, and the blades of a third row of blades having a pitch angle greater than the pitch angle of the blades of the second row and less than the stall angle of the blades, preferably about 13° greater than the pitch angle of the second row of blades.

The blades of a row of blades are circumferentially spaced apart relative to the chord length of the blades at a ratio of spacing to chord length within the range of about 0.75:1 to 1.5:1, preferably about unity. Each blade in the second row of blades, and in a third row of blades, is axially displaced from a blade in the preceding row of blades up to about one-half of the chord length of the preceding blade, preferably about one-third chord length, and each successive blade of a set of blades is laterally displaced not less than the chord thickness below the preceding blade such that the combined airflow from the preceding blade is directed over top of the said blade.

17 Claims, 6 Drawing Figures

FIG. 1.
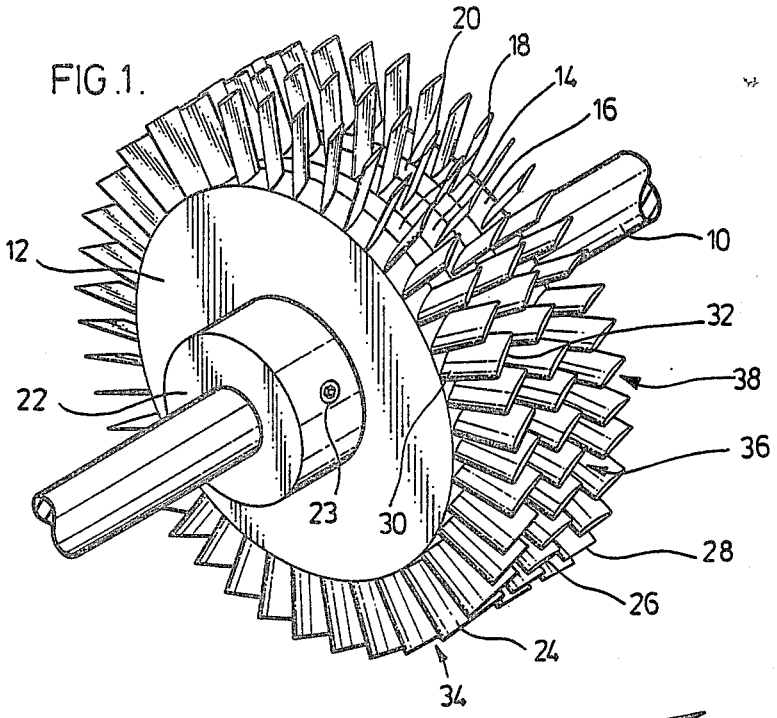
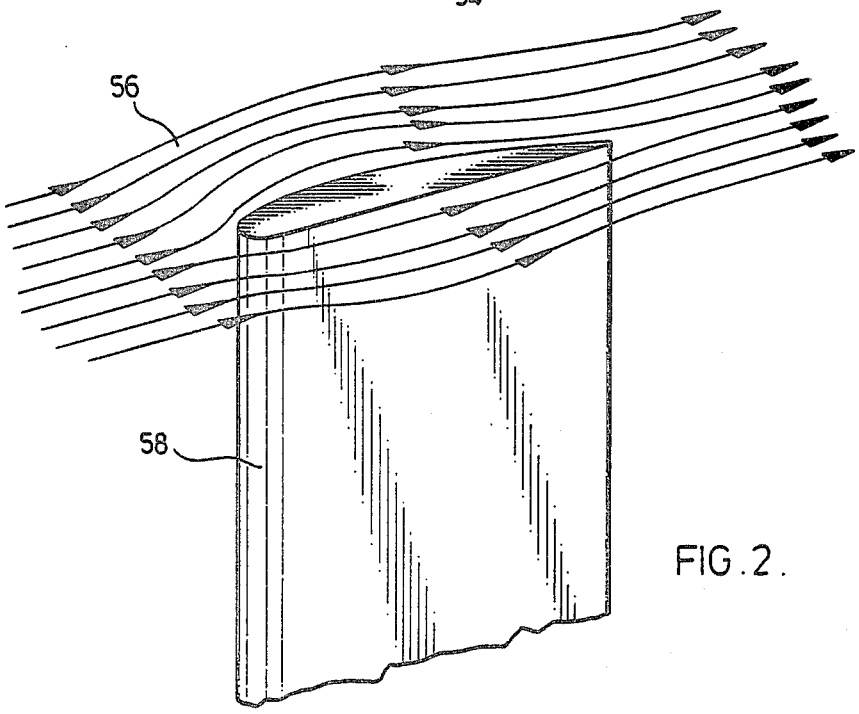
FIG. 2.

FIG. 3.
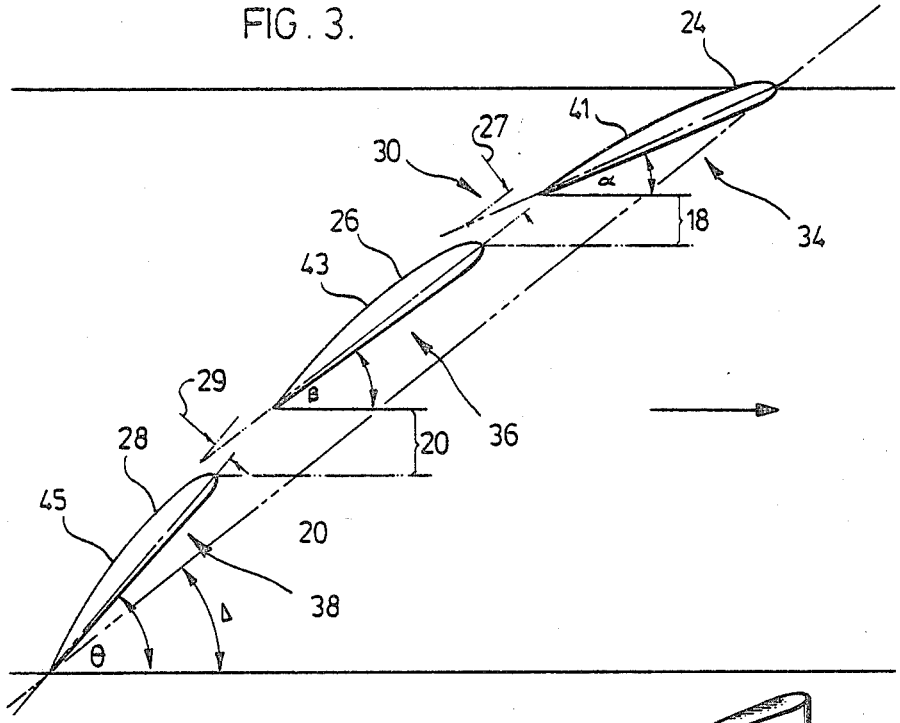
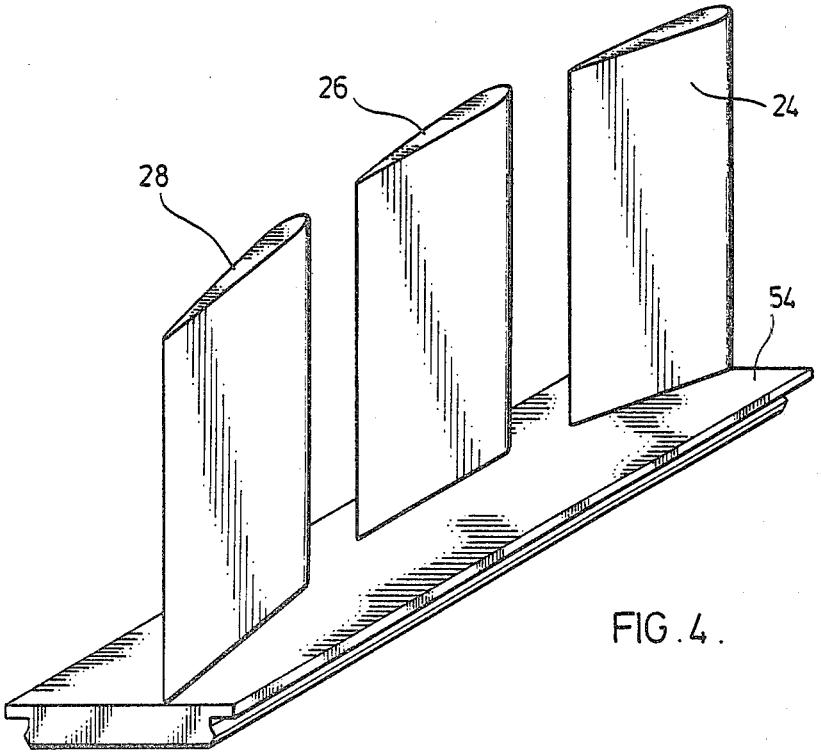
FIG. 4.

AXIAL FLOW IMPELLER

This invention relates to an axial flow apparatus and, more particularly, relates to an axial flow impeller.

Axial flow compressors, pumps and fans conventionally employ a plurality of radial blades mounted on a hub or rotor with the pitch of the blades changing from the rotor to the tip of the blades. Energy imparted to the fluid, such as air, is limited by the design of the blades and the velocity at which the blades rotate. Blower fans, for example, are limited to a maximum rotary speed in order to maintain the efficiency of the fan and to avoid the generation of noise caused by air leaving the surfaces of the blades at high speeds.

U.S. Pat. No. 3,867,062 discloses an axial flow apparatus for imparting energy to a fluid having two sets of blades axially displaced form each other on a common rotor. The first set of main blades and second set of auxilary blades have crescent shaped cross sections which vary in pitch between the hub and the tip of the blades, the trailing edge of the auxiliary blades froming an angle greater than 90° with the plane of rotation.

The axial flow impeller of the present invention has been found to be suprisingly effective in imparting energy to fluids such as air permitting use of a single stage impeller of relatively simple design and construction with reduced power consumption. The impeller of the present invention, in a broad aspect, comprises a rotor having a longitudinal axis, a first plurality of circumferentially equispaced blades secured substantially radially to said rotor for movement in a plane of rotation about said axis, each blade having a leading edge and a trailing edge forming a chord defining an angle less than the stall angle of the blade; and a second plurality of circumferentially equispaced blades secured radially to said rotor for movement in a plane of rotation with said first plurality of blades, each blade in said second plurality of blades having a leading edge and a trailing edge forming a chord defining an angle greater than the angle of the blades in the first plurality of blades and less than the stall angle of the blades, each blade in said second plurality of blades axially displaced from a blade in said first plurality of blades up to about one-half of the chord length of a blade in said first plurality of blades and laterally displaced from said blade in said first plurality of blades in the direction of rotation not less than the chord thickness, i.e. the maximum thickness, of the blade in the first plurality of blades so that the combined airflow from a blade in the first plurality of blades is directed over top of a blade in said second plurality of blades.

A preferred embodiment of this invention includes a third plurality of circumferentially equispaced blades secured substantially radially to said rotor for movement in a plane of rotation with said first and second plurality of blades, each blade in said third plurality of blades having a leading edge and a trailing edge forming a chord defining an angle to the plane of rotation greater than the angle of the blades in the second plurality of blades and less than the stall angle of the blade, each blade in said third plurality of blades axially displaced from a blade in said second plurality of blades up to about one-half of the chord length of a blade in said second plurality of blades and laterally displaced from said blade in said second plurality of blades not less than the chord thickness of the blade in the second plurality of blades below said blade in the second plurality of blades such that the combined airflow from the preceding blade is directed over top of the blade in the third plurality of blades.

The blades in the first plurality or row of blades define an angle in the range of about 17° to the blade stall angle relative to the plane of rotation, preferably about 22°, and the blades inthe second and third plurality of rows of blades define an angle in the range of about 10° greater than the angle of the blades inthe preceding plurality of blades up to the stall angles of the blades, preferably about 13° greater than the angle of the blades in the preceding plurality of blades.

The blades of a row of blades are circumferentially spaced apart relative to the chord length of the blades at a ratio of spacing to chord length within the range of about 0.75:1 to 1.5:1. A preferred embodiment of the invention utilizes blades having an airfoil section, the blades of a row of blades being circumferentially spaced apart at a ratio of spacing to chord length of about 1:1, chord angles of the blades in the first, second and third plurality of blades defining angles to the plane of rotation of 22°, 35° and 48°, respectively, and axial spacing of the first, second and third plurality of blades being about one-third chord length from each other, said blades having substantially the same pitch throughout their radial lengths.

The axial flow impeller of the invention will now be described with reference to the accompanying drawings, in which:

FIG. 1 is a perspective view of an embodiment of axial flow impeller of the invention;

FIG. 2 illustrates a section of blade length having an airfoil section indicating the flow of a fluid such as air over the airfoil section;

FIG. 3 illustrates an end view of a set of blades of the invention indicating the angles of pitch of a blade in each of the first, second and third plurality of blades, relative to the plane of rotation;

FIG. 4 is a perspective view of a set of blades of the invention mounted on a common support base;

Figure 6:
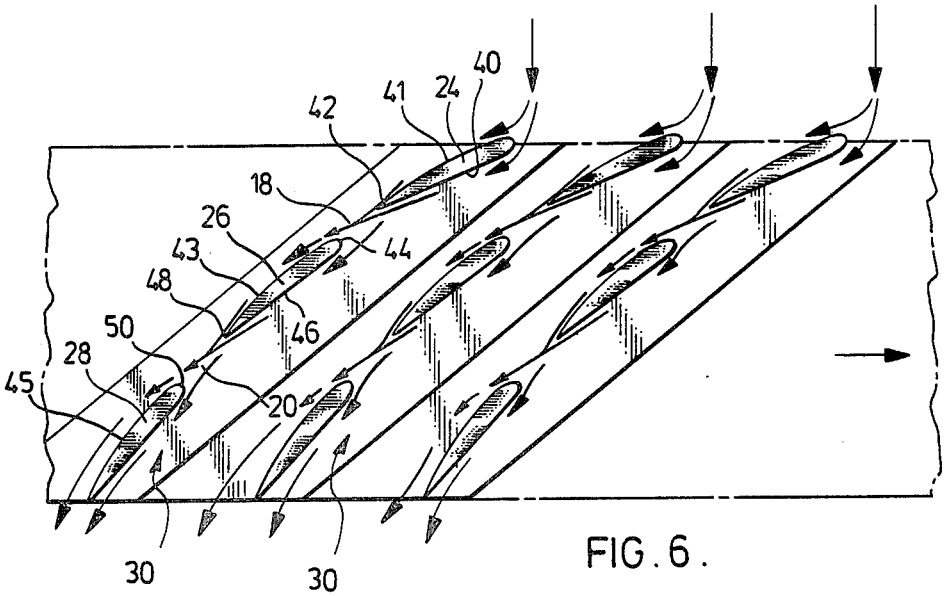
FIG. 6 illustrates an end view of sets of blades of the present invention indicating fluid flow about each set of interacting blades.

The embodiment of the invention illustrated in FIG. 1 comprises a shaft 10 having three discs 12, 14 and 16 mounted coaxially thereon with spacers between the discs, not shown, for separating discs 12 and 14 a distance apart designated by numeral 18 and discs 14 and 16 a distance apart designated by numeral 20. Discs 12, 14 and 16 are fixed on shaft 10 in their respective postions by frictional engagement on one side with ring 22 secured to shaft 10 by set screw 23 and on the other side with a collar, not shown, threaded onto shaft 10 for abutment against disc 16. The axial spacing 18, 20 of the discs can be readily adjusted by varying the thickness of spacers and the circumferential relationship of the discs can be adjusted by rotational adjustment of the discs. The blades in their selected positions are locked together to rotate as a fixed common unit.

Each of discs 12, 14 and 16 has a plurality of equispaced blades 24, 26 and 28, respectively, substantially raidally secured to the circumferences thereof. Blades 24, 26 and 28 preferably are of the same size and shape and each blade has a fixed pitch from root section 30 to tip 32 relative to the respective plane of rotation, to be discussed. An airfoil cross section of the well known Clark 'Y' type is preferred.

FIG. 3 illustrates a typical arrangement of sequentially aligned blades 24, 26 and 28 which comprise a set 30 and shows the progressive increase in chord angle to the plane of rotation from blade 24 to blade 28.

The first plurality of row 34 of blades 24 defines a relatively shallow pitch angle $\alpha$ to the plane of rotation within the range of about 17° to the stall of the blade, preferably about 22°. The second plurality 36 of blades 26 define as increased pitch angle about 10° greater than the pitch angle of blades 24 up to the stall angle of the blades, preferably about 13° greater than the pitch angle of blades 24, and the third plurality 38 of blades 28 define a further increased pitch angle about 10° greater than the pitch angle of blades 26 up to the stall angle of the blades, preferably about 13° greater than the pitch angle of blades 26. A pitch angle $\beta$ for the blades 26 of about 35° and a pitch angle $\theta$ for the blades 28 of about 48° are thus preferred, the upper limit of angles $\alpha$, $\beta$ and $\theta$ being determined by the stall angle of the blades at their rotational velocity.

With reference now to FIG. 6, the axial spacings 18, 20 between the rows of blades 34, 36 and 38 must be adequate to permit air flowing under surface 40 of blades 24 to pass between the trailing edge 42 of blades 24 and the leading edge 44 of blades 26 to combine with air flowing over surface 41 of blades 24 for direction onto the upper surface 43 of blades 26 and to permit the air flowing under surface 46 of blades 26 to pass between the trailing edge 48 of blades 26 and the leading edge 50 of blades 28 to combine with air flowing over surface 43 of blades 26 for direction onto the upper surface 45 of blades 28. An axial spacing 18, 20 of up to about one-half the blade chord length, preferably about one-third the blade chord length, permits a suitable flow of air between successive blades.

Lateral spacing of each successive blade of a set of blades in the direction of rotation of the blades, i.e. the displacement of the chord line of the following blade relative to the combined air stream from the preceding blade of not less than the chord thickness, depicted by numerals 27, 29, ensures the flow of combined air over top of the successive blades.

The sets of 30 of blades are circumferentially equispaced apart from each other at a ratio of spacing to blade chord length within the range of 0.75:1 to 1.5:1, preferably about 1:1.

FIG. 4 illustrates another embodiment of the invention in which a set of 30 of successive blades 24, 26 and 28 are mounted on a rotor plate 54 for convenient securement to a common disc mounted on a rotatable shaft.

Figure 5:
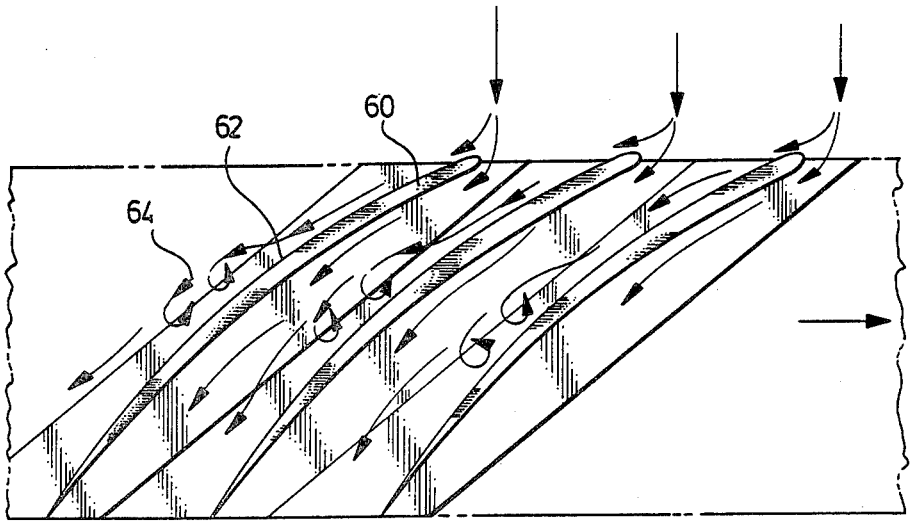
FIG. 5 illustrates curved blades of a conventional impeller indicating separation of fluid flow from the low pressure sides of the blades.

FIG. 2 shows an airstream 56 over a Clark 'Y' type of blade 58 having an airfoil section. A conventional impeller blade 60 illustrated in FIG. 5 suffers from air leaving the low pressure surface 62 in the area depicted by numeral 64 under high velocity flow conditions to cause loss of efficiency and to generate undesired noise. The impeller of the present invention substantially avoids these problems to provide enhanced air flow with a quiet impeller operation.

It will be understood of course that modifications can be made in the embodiments of the invention described and illustrated herein without departing from the scope and purview of the invention as defined in the appended claims.

What I claim as new and desire to protect by Letters Patent of the United States is:

1. An axial flow impeller comprising a rotor, said rotor having a longitudinal axis, a first plurality of circumferentially equispaced blades secured substantially radially to said rotor for movement in a plane of rotation about said axis, each blade having a leading edge and a trailing edge forming a chord defining an angle to the plane of rotation less than the stall angle of the blade;

a second plurality of circumferentially equispaced blades secured radially to said rotor for movement in a plane of rotation with said first plurality of blades, each blade in said second plurality of blades having a leading edge and a trailing edge froming a chord defining an angle to the plane of rotaton greater than the angle of the blades in the first plurality of blades and less than the stall angle of the blade, each blade in said second plurality of blades axially displaced from a blade in said first plurality of blades up to about one-half of the cord length of a blade in said first plurality of blades and laterally displaced from said blade in said first plurality of blades not less than the chord thickness of the blade in the first plurality of blades below the said blade in the first plurality of blades such that combined airflow from the blade in the first plurality of blades is directed over top of the blade in the second plurality of blades.

2. An axial flow impeller as claimed in claim 1 in which each blade in said first plurality of blades defines an angle in the range of about 17° of the blade stall angle and each blade in the second plurality of blades defines an angle in the range of about 10° greater than the angle of the blades in the first plurality of blades to the stall angle of the blades.

3. An axial flow impeller as claimed in claim 1 in which each blade in said first plurality of blades defines an angle of about 22° and each blade in the second plurality of blades defines an angle about 13° greater than the angle of the blades in the first plurality of blades.

4. An axial flow impeller as claimed in claim 1 which additionally comprises a third plurality of circumferentially equispaced blades secured radially to said rotor for movement in a plane of rotation with said first and second plurality of blades, each blade in said third plurality of blades having a leading edge nd a trailing edge forming a chord defining an angle to the plane of rotation greater than the angle of the blades in the second plurality of blades and less than the stall angle of the blade, each blade in said third plurality of blades axially displaced from a blade in said second plurality of blades up to about one-half of the chord length of the blade in said second plurality of blades and laterally displaced from said blade in said second plurality of blades not less than the chord thickness of the blade in the second plurality of blades below the said blade in the second plurality of blades such that the combined airflow from the preceding blade is directed over top of the blade in the third plurality of blades.

5. An axial flow impeller as claimed in claim 4 in which each blade in said first plurality of blades defines an angle in the range of about 17° to the blade stall angle and each blade in the second and third plurality of blades defines an angle in the range of about 10° greater than the angle of the blades in the preceding plurality of blades up to the stall angle of the blades in the second and third plurality of blades.

6. An axial flow impeller as claimed in claim 4 in which each blade in said first plurality of blades defines an angle of about 22° to the plane of rotation and each blade in the second and third plurality of blades defines an angle about 13° greater than the angle of the blades in the preceding plurality of blades.

7. An axial flow impeller as claimed in claim 5 in which said blades of a plurality of blades are circumferentially spaced apart relative to the chord length of the blades at a ration within the range of about 0.75:1 to 1.5:1.

8. An axial flow impeller as claimed in claim 5 in which said blades of a plurality of blades are circumferentially spaced apart relative to the chord length of the blades at a ratio of about 1:1.

9. An axial flow impeller as claimed in claim 2 in which said blades have an airfoil section.

10. An axial flow impeller as claimed in claim 7 in which said blades have an airfoil section.

11. An axial flow impeller as claimed in claim 7 in which said blades are of equal size and have an airfoil section, the blades of the first plurality of blades defining an angle of about 22° to the plane of rotation, the blades of the second plurality of blades defining an angle of about 35° to the plane of rotation, and the blades of the third plurality of blades defining an angle of about 48° to the plane of rotation.

12. An axial flow impeller as claimed in claim 5 in which each blade in said second and third plurality of blades is axially displaced from a blade in said first and second plurality of blades respectively about one-third of the chord length of the blade in the first and second plurality of blades.

13. An axial flow impeller as claimed in claim 7 in which each blade in said second and third plurality of blades is axially displaced from a blade in said first and second plurality of blades respectively about one-third of the chord length of the blade in the first and second plurality of blades.

14. Am axial flow apparatus as claimed in claim 5 in which said rotor comprises three discs co-axially mounted on a shaft, each disc having said blades secured radially on the circumference thereof.

15. An axial flow apparatus as claimed in claim 7 in which said rotor comprises three disc co-axially mounted on a shaft, each disc having said blades secured radially on the circumference thereof.

16. An axial flow impeller as claimed in claim 5 in which said blades define a constant pitch angle throughout their radial lengths.

17. An axial flow impeller as claimed in claim 7 in which said blades define a constant pitch angle throughout their radial lengths.

* * * * *